United States Patent [19]

Stepp et al.

[11] Patent Number: 4,683,955

[45] Date of Patent: Aug. 4, 1987

[54] AUTOMATIC FILL-UP FLOATING APPARATUS

[75] Inventors: Lee W. Stepp, Comanche; Morris G. Baldridge; Harold O. Treece, both of Duncan, all of Okla.

[73] Assignee: Halliburton Company, Duncan, Okla.

[21] Appl. No.: 858,141

[22] Filed: Apr. 30, 1986

[51] Int. Cl.[4] ..... E21B 34/00

[52] U.S. Cl. ..... 166/327; 166/326

[58] Field of Search ..... 166/366, 367, 332; 137/71

[56] References Cited

U.S. PATENT DOCUMENTS

| | | | |
|---|---|---|---|
| 2,846,015 | 8/1958 | Pittman | 166/224 |
| 3,385,370 | 5/1968 | Knox et al. | 166/225 |
| 3,385,372 | 5/1968 | Knox | 166/225 |
| 3,409,078 | 11/1968 | Knox et al. | 166/21 |
| 3,776,250 | 12/1973 | Knox | 137/71 |
| 4,067,358 | 1/1978 | Streich | 137/624.13 |
| 4,457,377 | 7/1984 | Burris, II | 166/332 |

OTHER PUBLICATIONS

Halliburton Services Sales and Service Catalog No. 43, pp. 2431–2434.

*Primary Examiner*—Stephen J. Novosad

*Assistant Examiner*—Thomas J. Odar

*Attorney, Agent, or Firm*—Joseph A. Walkowski; Neal R. Kennedy

[57] ABSTRACT

An automatic fill-up floating apparatus usable in a float collar or a float shoe in a casing string. The apparatus includes a housing having a back check valve positioned therein. A spring biases the valve toward a closed position. A filling body is disposed across an opening at a lower end of the housing and includes a flow passage therethrough. The filling body is shearably pinned to a valve stem extending from the valve and has a holding position in which the valve is held in an open position. A resilient washer is annularly positioned around the valve stem and above the filling body. The washer is free to move upwardly in response to upward movement of flow through the flow passage in the filling body as the casing string is lowered into a well. The floating apparatus may be tripped by pumping fluid downwardly through the casing strings such that the washer is forced against the filling body, sealingly covering the flow passage therethrough. When there is sufficient differential pressure across the washer and filling body, the shear pin will be sheared such and the body released from the valve stem. Thereafter, the spring will be free to move the valve to a closed position when downward fluid flow drops sufficiently.

13 Claims, 7 Drawing Figures

AUTOMATIC FILL-UP FLOATING APPARATUS

BACKGROUND OF THE INVENTION

1. Field of The Invention

Figure 1:
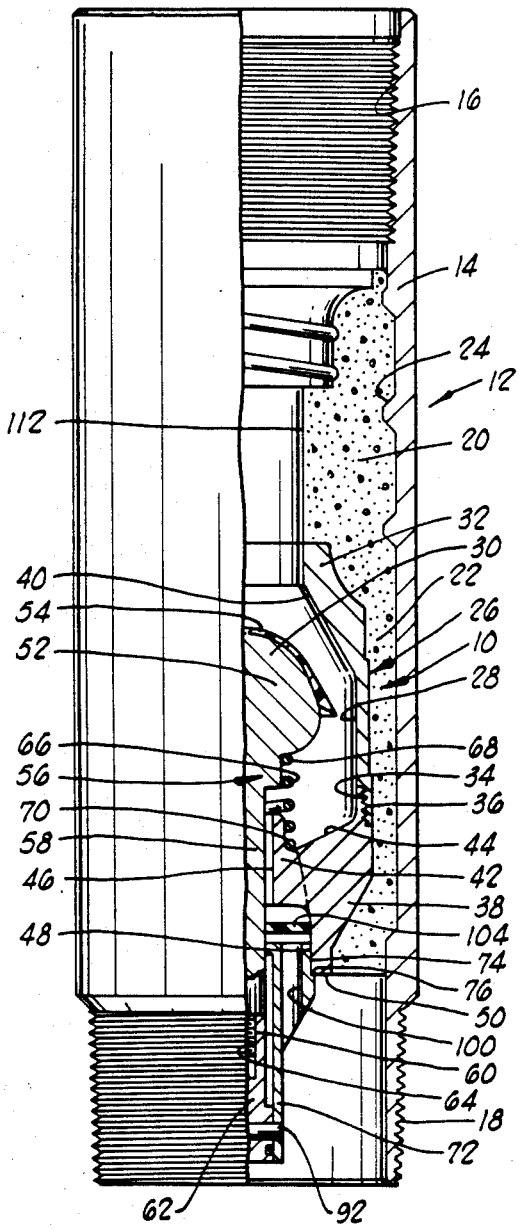

This invention relates to floating apparatus used in well casings, and more particularly, to a floating apparatus having an automatic filling body for allowing upward flow therethrough as the casing is lowered into a well.

2. Description of The Prior Art

An automatic fill-up floating apparatus is shown in Halliburton Services Sales and Service Catalog No. 43, pages 2431–2434. This apparatus may be used in either Halliburton Super Seal float collars of Halliburton Super Seal float shoes. An orifice sleeve is shearably attached to a valve stem and holds a valve element in an open position off a seat as the casing is lowered into the well. Two fluid orifices meter the flow and allow the casing to fill from below. The orifices are always open, and the orifice sleeve may be released from the valve stem by pumping a sufficient flow rate of fluid downwardly through the casing. This downward fluid flow through the orifices will cause a shear pin holding the valve stem to the sleeve to be sheared so that the sleeve will move downwardly therefrom, and the valve thereafter will be free to return to a fully closed position when the flow stops. In the float shoe configuration, the sleeve merely drops down the casing string below the entire apparatus. In the float collar configuration, a shoulder in the sleeve engages a shoulder on the valve stem to keep the orifice sleeve from falling on down the casing string while still allowing substantially full flow thereby for normal operation of the floating apparatus.

A problem with such previous automatic fill-up floating apparatus is that the orifices restrict flow as the casing is lowered into the well, and thus the differential pressure across the orifice sleeve is increased. This results in the casing string moving slowly down the well bore. Further, because downward flow through the orifices is not totally precise, the exact force applied to the sleeve is unknown, and the exact time at which shearing of the shear pin occurs is also not known. Positioning of the orifice sleeve must be very precise in this apparatus so that the orifices are in the proper relationship to the housing. Improper positioning may adversely affect the flow rate which could result in undesired release of the orifice sleeve or possibly failure of release. Also, the constant bypassing of fluid downwardly flowing through apparatus tends to clog up the orifices which again can result in improper actuation.

The automatic fill-up floating apparatus of the present invention solves these problems by providing a filling body pinned to the valve stem rather than an orifice sleeve. The filling body has a flow passage therethrough which is totally closed by a resilient washer in response to downward fluid movement through the apparatus. Precise alignment of the filling body is not required. The filling body will be moved, and thus the shear pin sheared, only when there is a known pressure differential across the washer. Thus, there is more precise tripping of the mechanism in the present invention than in the prior art.

SUMMARY OF THE INVENTION

The automatic fill-up floating apparatus of the present invention comprises an enclosure or housing, back check means having a variably open position for allowing fluid flow through the enclosure in a first, generally downward direction and a closed position for preventing the fluid flow through the enclosure in a second, generally upward direction opposite the first direction, biasing means for biasing the back check means from the open position to the closed position, filling means for overcoming the biasing means and having a holding position for releasably holding the back check means in an open position and allowing fluid flow through the enclosure in the second direction, and releasing means for releasing the filling means from the back check means. The releasing means prevents fluid flow through the enclosure in the first direction prior to releasing the filling means.

Normally, the enclosure forms an inner portion of either a float collar or a float shoe. Both the float collar and float shoe have a casing portion, and means are provided for fixedly locating the enclosure in the casing portion. The casing and enclosure define an annular cavity therebetween, and the means for fixedly locating the enclosure preferably comprises cement filling the annular cavity.

The back check means comprises a seating surface on the enclosure, a valve slidingly engageable with the seating surface, a valve stem attached to the valve, and guide means for guiding the stem and thus the valve.

The filling means preferably comprises a body positioned in the enclosure and adapted for receiving a portion of the valve stem and shear means for shearably connecting the valve stem portion and the body. The body defines flow passage means therethrough in communication with a central opening through the enclosure.

The releasing means preferably comprises passage closing means for closing the flow passage in the body in response to fluid flow in the first direction and transmitting a force due to fluid differential pressure thereacross to the body for shearing the shear means and thereby releasing the valve stem from the body. The passage closure means is best characterized by a resilient washer adjacent an end of the flow passage and adapted for sealingly covering the flow passage in response to downward flow and for moving to a position spaced from the body in response to upward flow.

In the embodiment in which the enclosure forms an inner portion of a float collar, the apparatus further comprises body retaining means for retaining the body in partial engagement with the valve stem even after shearing of the shear means. The body retaining means comprises first shoulder means on the valve stem and second shoulder means on the body. The first and second shoulder means are mutually engageable due to downward movement of the body by fluid flow after shearing the shear means.

An important object of the present invention is to provide an automatic fill-up floating apparatus in which the pressure required for tripping the apparatus is precisely known.

Another object of the invention is to provide an automatic fill-up floating apparatus in which downward fluid flow therethrough is prevented prior to tripping.

A further object of the present invention is to provide an automatic fill-up floating apparatus having a filling body with a holding position holding a back check valve in an open position and further having a resilient washer positioned above the filling body for closure of a flow passage therethrough in response to downward As hereinbefore described, valve stem 56 of valve 30 is releasably attached to filling body 72 by shear pin 92, and although spring 66 tends to move valve 30 upwardly, the engagement of shoulder 76 of filling body 72 with lower end 50 of housing 26 prevents upward movement of the valve and filling body beyond the position shown in FIG. 1. Thus, filling body 72 is in a holding position in which valve 30 is held in an open position such that sealing member 54 is spaced from seating surface 40. The upward force on valve 30 by spring 66 is overcome when the filling body is in this holding position shearably connected to valve system 56. In other words, as long as shear pin 92 is in place, valve 30 cannot close against seating surface 40 on housing 26.

As the casing string is lowered into a well bore, fluid is free to enter the lower portion of the casing string and pass upwardly through the flow passage formed by openings 100. The upward movement of fluid will force washer 104 away to a position spaced from upper surface 110 of filling body 72, and thus fluid will pass upwardly through central opening 28 of housing 26, past open valve element 52 of valve 30 and further upwardly through central opening 112 of float collar 12 into the upper casing portion. Thus, floating apparatus 10 of the present invention provides filling means for holding valve 30 in an open position and allowing fluid flow upwardly through the casing string.

Floating apparatus 10 may be "tripped" so that filling body 72 is released from valve stem 56 of valve 30. This is accomplished by pumping fluid downwardly through the casing string into float collar 12. It will be seen that the downward flow of fluid will force washer 104 into sealing engagement with upper surface 110 of filling body 72, thus acting as a flow passage closure means for covering openings 100 and closing the flow passage through the filling body. Because washer 104 completely covers and closes the flow passage through filling body 72, the exact force exerted downwardly on the filling body and on shear pin 92 due to the differential pressure across filling body 72 is known. Thus, the exact pressure available for shearing shear pin 92 is known, the tripping of the apparatus of the present invention is more precise than previously known automatic fill-up floating apparatus which required a downward fluid flow rate through an orifice for releasing an orifice sleeve.

Figure 4:
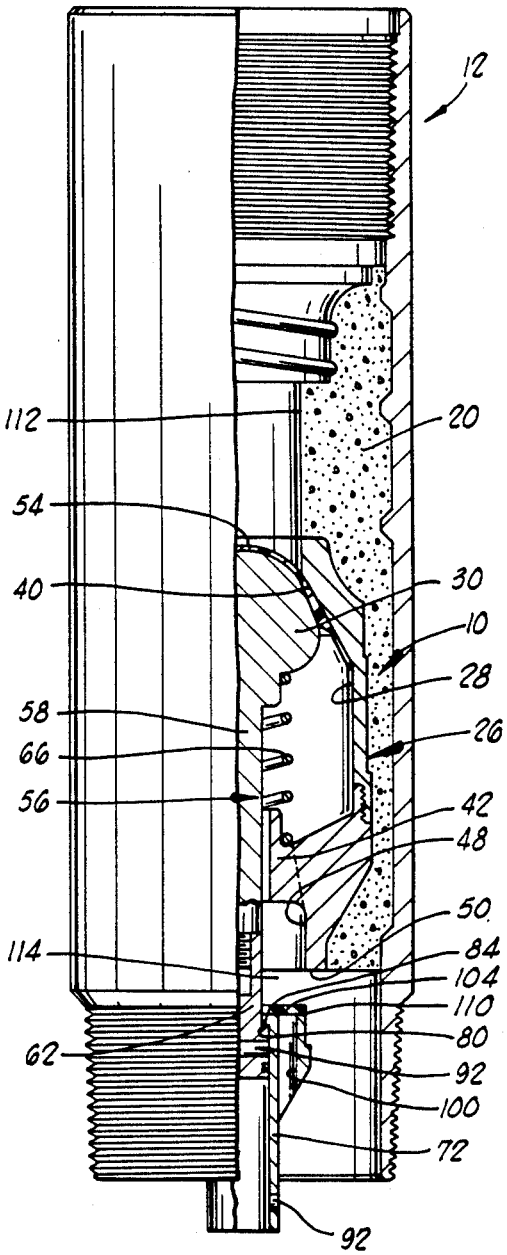
Figure 2:
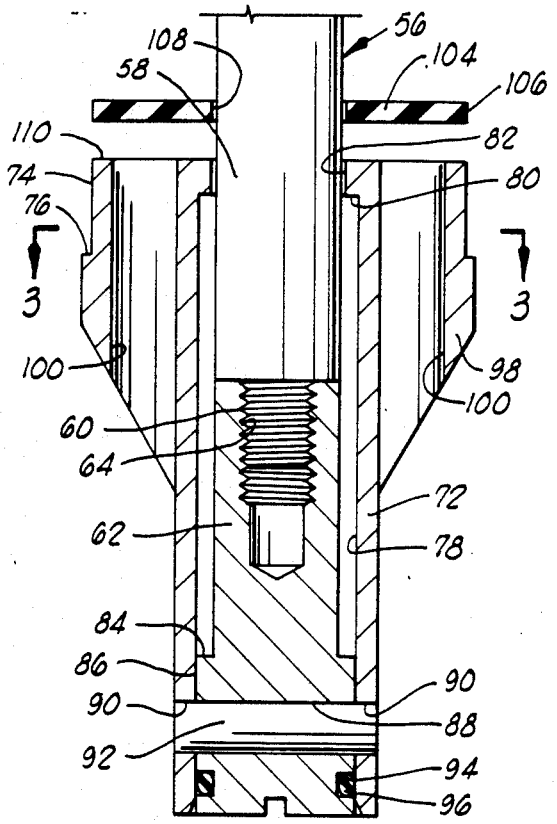

After shear pin 92 is sheared washer 104 and filling body 72 are moved further downwardly by the resultant flow of fluid until shoulder 80 in the filling body engages shoulder 84 on retaining nut 64 of valve stem 66, as shown in FIG. 4. Shoulder 84 and shoulder 80 thus keep valve stem 56 and filling body partially engaged and provide first and second shoulder means, respectively, which, when mutually engaged, act as body retaining means for preventing filling body 72 and washer 104 from falling down the casing string below float collar 12.

As will be seen to those skilled in the art, as soon as shear pin 92 is sheared, spring 66 is free to upwardly move valve 30 toward seating surface 40 on housing 26. At this point, floating apparatus 10 of the present invention will function in a manner similar to other floating apparatus known in the art. Sufficient downward flow through central opening 112 of float collar 12 will force valve 30 downwardly to a variably open position, depending upon the flow rate. When the downward flow rate drops sufficiently, spring 66 again forces sealing member 54 on valve element 52 into seated and sealing engagement with seating surface 40 of housing 26. After release of filling body 72 from valve stem 56, further upward flow of fluid through apparatus 10 is prevented by valve 30. Thus, valve 30 acts as a back check means for allowing fluid flow through housing 26 in a first, downward direction and for preventing fluid flow through the housing in a second, upward direction.

Even when valve 30 is in a closed position, as shown in FIG. 4, valve stem 56 is sufficiently long so that filling body 72 hanging from the lower end of the valve stem is spaced from lower end 50 of housing 26 such that an adequate flow annulus 114 is provided therebetween, no matter how far valve 30 is open with respect to seating surface 40.

Figure 5:
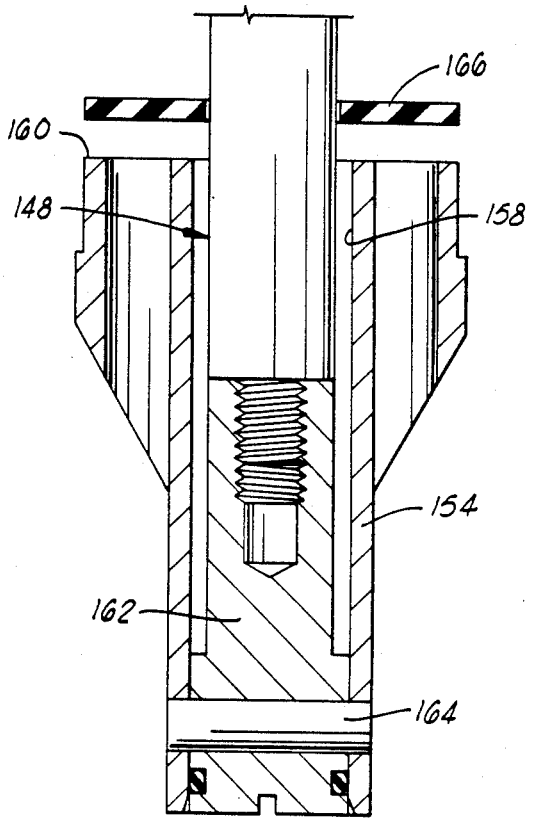
Figure 3:
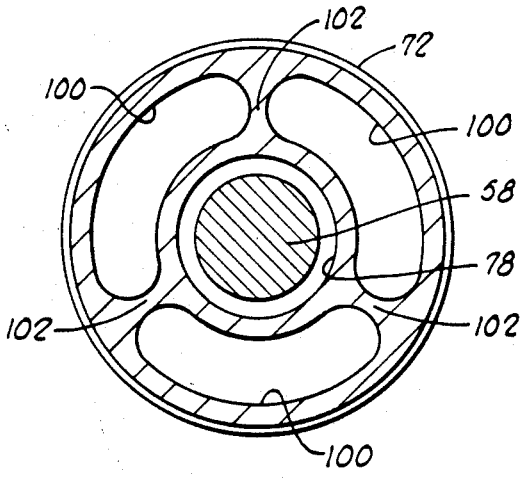
Figure 5:
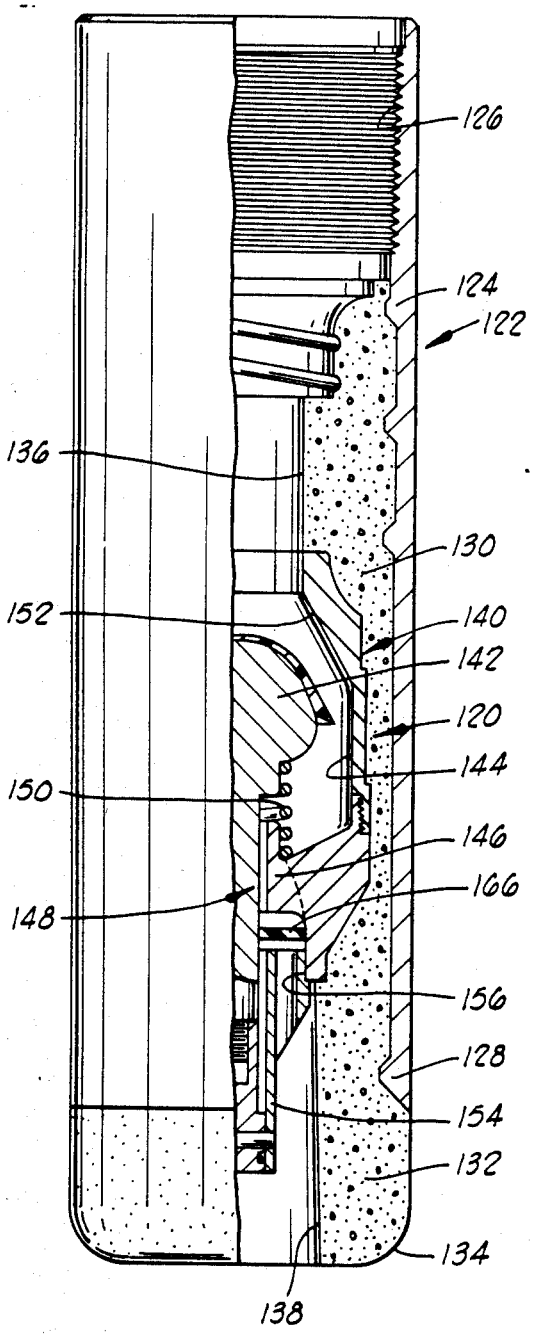
Figure 7:
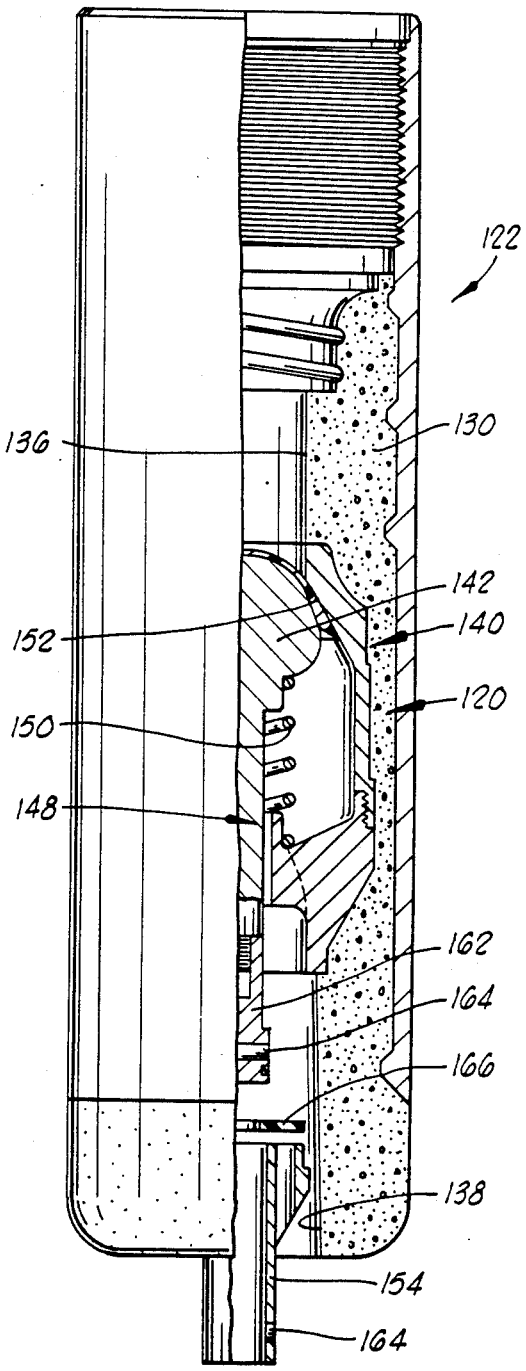

Referring now to FIGS. 5–7, a second embodiment of the floating apparatus of the present invention is shown, and generally designated by the numeral 120, as forming an inner portion of a float shoe, generally designated by the numeral 122. Float shoe 122 includes an outer casing sleeve 124 having an internally threaded upper end 126 adapted for engagement with a casing string (not shown) and a lower end 128. Floating apparatus 120 is fixedly located in sleeve 124 of float shoe 122 by a substantially annular cement portion 130. Cement portion 130 has a lower end 132 which extends below lower end 128 of sleeve 124. Lower end 132 of cement portion 130 has a rounded lower edge 134 of a kind known in the art for guiding the casing string down a well bore. Cement portion 130 defines central openings 136 and 138 in casing shoe 122 which extend above and below floating apparatus 120, respectively.

Floating apparatus 120 includes an enclosure or housing 140, substantially identical to housing 26 in the first embodiment and a valve 142, substantially identical to valve 30 in the first embodiment, disposed in a central opening 144 of the housing. Central opening 144 is in communication with upper and lower central openings 136 and 138 of cement portion 130 of float shoe 122.

Housing 140 further includes a valve guide 146 for guiding valve stem 148 of valve 142. A spring 150 upwardly biases valve 142 toward seating surface 152 in housing 140.

A filling body 154 is disposed across a body receiving bore 156 at the lower end of housing 140. Filling body 154 defines a central opening or cavity 158 therethrough for receiving a portion of valve stem 148. The only distinction between filling body 154 and filling body 72 of the first embodiment is that filling body 154 has no inwardly extending shoulder at the upper end of central opening 158. In other words, opening 158 extends straight upwardly and intersects upper surface 160 of filling body 154.

A retaining nut portion 162 at the lower end of valve stem 148 is releasably attached to filling body 154 by a shear pin 164, in the same manner as the first embodiment. A resilient washer 166 is annularly disposed around valve stem 148 and longitudinally positioned between valve guide 146 and filling body 154.

Filling body 154 has a holding position, as shown in FIG. 5, which holds valve 142 in an open position, just as in the first embodiment, for facilitating filling of the casing string as the casing string is lowered into the well bore.

Tripping of floating apparatus 120 by downward fluid flow is performed in the same manner as with the first embodiment. However, after shearing of shear pin 164, it will be seen that further downward movement of filling body 154 is unrestricted, and filling body 154 will be free to fall to the bottom of the well bore because there is no internal shoulder in filling body 154 to engage the shoulder on retaining nut 162. This is illustrated in FIG. 7. Downward fluid flow will normally also carry washer 166 downwardly from float shoe 122 and free of central opening 138 so that there will be unrestricted flow therethrough.

After release of filling body 154, spring 150 will bias valve 142 into engagement with seating surface 152 in housing 140. Thereafter, floating apparatus 120 will function in the same manner as other floating apparatus known in the art.

It will be seen, therefore, that the automatic fill-up floating apparatus of the present invention is well adapted to carry out the ends and advantages mentioned, as well as those inherent therein. While two presently preferred embodiments of the apparatus forming a part of a float collar and of a float shoe are illustrated for the purposes of this disclosure, numerous changes in the construction and arrangement of parts may be made by those skilled in the art. All such changes are encompassed within the scope and spirit of the appended claims.

What is claimed is:

1. A floating apparatus for use in a well casing, said apparatus comprising:

a housing having a seating surface thereon and defining a central opening therethrough;

a valve disposed in said housing central opening and movable therein between a closed position sealingly engaged with said sealing surface and a variably open position allowing fluid flow downwardly through said housing;

biasing means for biasing said valve to said closed position;

a filling body defining a flow passage therethrough and at least partially disposed in said housing central opening at the bottom thereof, said filling body having a holding position in which said body is attached to said valve such that said valve is held in an open position for allowing fluid flow relatively upwardly through said casing as said casing is lowered into a well and a released position spaced from said holding position;

shoulder means on said filling body abutting said housing proximate said central opening bottom; and closure means for closing said flow passage in response to downward fluid flow through said casing, whereby said body is released from said valve when a fluid differential pressure reaches a predetermined level, said fluid flow thereafter moving said body to said released position.

2. The apparatus of claim 1 further comprising shear means for attaching said body to said valve in said holding position.

3. The apparatus of claim 1 wherein:

said filling body defines a central opening therethrough; and said valve includes a stem extending in a direction opposite said seating surface, said stem being sliding received in said filling body central opening.

4. The apparatus of claim 3 further comprising a guide fixedly positioned in said housing central opening and defining a central opening therethrough for guidingly receiving said valve stem, and wherein said biasing means comprises a spring disposed around said valve stem and engaged with said guide.

5. The apparatus of claim 1 wherein said closure means comprises a resilient washer adjacent said filling body and adapted for sealingly covering said flow passage through said filling body in response to downward flow and for moving to a position spaced from said filling body in response to upward flow.

6. The apparatus of claim 5 wherein said washer in rubber.

7. The apparatus of claim 1 wherein:

said valve includes a shoulder thereon;

said filling body includes a shoulder thereon spaced from said valve shoulder when said body is in said holding position, said body shoulder engaging said valve shoulder when said body is in said released position.

8. A floating apparatus for use in a well, said apparatus comprising:

a casing portion;

a housing disposed in said casing portion and having a central opening therethrough, said housing comprising:

an upper portion having a downwardly facing seat thereon;

a valve guide disposed in said central opening; and a lower portion defining a body receiving bore therethrough in communication with said central opening and terminating at a lower end proximate the bottom of said central opening;

means for fixedly locating said housing in said casing portion; a valve disposed in said housing and comprising:

a valve element having an upwardly facing sealing surface engageable with said seat when said valve is in a closed position; and a valve stem extending downwardly from said valve element and guidingly received by said valve guide such that said valve is donwardly displaceable to a variably open position;

biasing means for biasing said valve to said closed position;

a filling body defining a cavity therein for receiving a portion of said valve stem and further defining a substantially longitudinal flow passage therethrough in communication with said housing central opening, said filling body having a holding position whereat said filling body extends upwardly at least partially into said body receiving bore in said housing, said filling body including upwardly facing shoulder means on the perimeter thereof abutting said lower end of said lower portion;

shear means for shearably attaching said valve stem to said filling body such that said valve is held in an open positon when said filling body is in said holding position; and flow passage closing means having a closed position for closing said flow passage through said filling body in response to downward fluid flow through said casing portion and an open position spaced from said filling body for allowing upward fluid flow through said casing portion when said valve is held in said open position by said shearing means.

9. The apparatus of claim 8 wherein said biasing means is characterized by a spring annularly disposed around said valve stem and longitudinally disposed between said valve guide and said valve element.

10. The apparatus of claim 8 wherein said body covering means is characterized by an annular washer disposed around said valve stem and longitudinally slidable between said valve guide and said filling body.

11. The apparatus of claim 10 wherein said washer is made of a resilient material and sealingly engages an upper surface of said filling body when in said closed position.

12. The apparatus of claim 8 wherein:

said filling body cavity has an inwardly extending shoulder therein; and said valve stem has an outwardly extending shoulder thereon spaced from said shoulder in said body when said valve stem is attached to said filling body and said filling body is in said holding position, such that when said shearing means is sheared, said filling body is free to move downwardly from said housing such that said body shoulder is engaged with said stem shoulder, preventing further downward movement of said body.

13. The apparatus of claim 8 further comprising sealing means between said valve stem and said filling body.

* * * * *

UNITED STATES PATENT AND TRADEMARK OFFICE

CERTIFICATE OF CORRECTION

PATENT NO. : 4,683,955

DATED : August 4, 1987

INVENTOR(S) : Lee W. Stepp, Morris G. Baldridge, Harold O. Treece

It is certified that error appears in the above-identified patent and that said Letters Patent is hereby corrected as shown below:

In column 2, line 30, delete "and" and insert --to-- therefore.

In column 5, line 12, delete "system" and insert --stem-- therefore.

In claim 8, line 39, delete "donwardly" and insert --downwardly-- therefore.

Signed and Sealed this

Twenty-fourth Day of November, 1987

*Attest:*

*Attesting Officer*

DONALD J. QUIGG

*Commissioner of Patents and Trademarks*